US008633413B2

(12) United States Patent
Cernat et al.

(10) Patent No.: US 8,633,413 B2
(45) Date of Patent: Jan. 21, 2014

(54) SWITCHGEAR ASSEMBLY WITH A CONTACT GAP

(75) Inventors: Radu-Marian Cernat, Berlin (DE); Hold Dienemann, Berlin (DE); Stefan Giere, Berlin (DE); Volker Lehmann, Treuenbrietzen (DE); Manfred Meinherz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 205 days.

(21) Appl. No.: 13/201,470

(22) PCT Filed: Jan. 26, 2010

(86) PCT No.: PCT/EP2010/050826
§ 371 (c)(1),
(2), (4) Date: Aug. 15, 2011

(87) PCT Pub. No.: WO2010/091944
PCT Pub. Date: Aug. 19, 2010

(65) Prior Publication Data

US 2011/0297647 A1 Dec. 8, 2011

(30) Foreign Application Priority Data

Feb. 13, 2009 (DE) ..... 10 2009 009 452

(51) Int. Cl.
*H01H 33/88* (2006.01)

(52) U.S. Cl.
USPC ..... 218/59

(58) Field of Classification Search
USPC ..... 218/43, 53–59
See application file for complete search history.

(56) References Cited

U.S. PATENT DOCUMENTS

| | | | | | |
|---|---|---|---|---|---|
| 4,161,636 | A | * | 7/1979 | Maier | 218/59 |
| 4,199,670 | A | | 4/1980 | Takeda et al. | |
| 4,418,256 | A | * | 11/1983 | Graf | 218/53 |
| 4,748,305 | A | * | 5/1988 | Luginbuhl | 218/53 |
| 4,798,924 | A | | 1/1989 | Ackermann | |
| 5,229,561 | A | | 7/1993 | Seki et al. | |
| 5,750,949 | A | * | 5/1998 | Rees et al. | 218/43 |
| 5,905,243 | A | | 5/1999 | Zehnder et al. | |
| 2007/0068904 | A1 | | 3/2007 | Dahlquist et al. | |
| 2009/0261070 | A1 | | 10/2009 | Haberer | |

FOREIGN PATENT DOCUMENTS

| | | |
|---|---|---|
| DE | 195 26 805 A1 | 1/1997 |
| DE | 195 47 522 C1 | 1/1997 |
| DE | 695 15 701 T2 | 11/2000 |

(Continued)

OTHER PUBLICATIONS

German Patent and Trademark Office Search Report, Dated May 18, 2009.

*Primary Examiner* — Truc Nguyen
(74) *Attorney, Agent, or Firm* — Laurence A. Greenberg; Werner H. Stemer; Ralph E. Locher

(57) ABSTRACT

A switchgear assembly has a contact gap and an insulating material nozzle. The insulating material nozzle at least partly encloses the contact gap. A nozzle channel for the insulating material nozzle opens with a outlet opening in a hot gas space. A deflector element is disposed within the hot gas space which defines a deflector channel. The deflector channel has a segment which has an expanding cross-section in the stream direction of a switching gas in the hot gas space.

17 Claims, 3 Drawing Sheets

(56) References Cited

FOREIGN PATENT DOCUMENTS

| | | | |
|---|---|---|---|
| EP | 0783173 | A1 | 7/1997 |
| EP | 0 806 049 | A1 | 11/1997 |
| EP | 1 768 150 | A1 | 3/2007 |
| EP | 1768150 | A1 | 3/2007 |
| JP | 2 -86023 | A | 3/1990 |
| JP | 10149750 | A | 6/1998 |
| KR | 1020070034972 | A | 3/2007 |
| WO | 2008/012238 | A1 | 1/2008 |

* cited by examiner

SWITCHGEAR ASSEMBLY WITH A CONTACT GAP

BACKGROUND OF THE INVENTION

Field of the Invention

The invention relates to a switchgear assembly having an insulating material nozzle at least partially enclosing a contact gap with a nozzle channel which opens out into a hot gas space in which is arranged a deflector element with deflector channel, wherein extinguishing gas discharging from the nozzle channel in the discharge direction into the hot gas space is diverted into the deflector channel.

A switchgear assembly of this kind is disclosed, for example, in the patent abstract of Japan JP 02-086023. This describes a switchgear assembly which has a hot gas space. A nozzle channel of an insulating material nozzle opens out into the hot gas space. A deflector element with deflector channel is arranged in the hot gas space in order to divert and guide gas flows in the hot gas space. Switching gas discharging from the nozzle channel is fed into the deflector channel of the deflector element. In doing so however, due to the position of the deflector channel and nozzle channel relative to one another, only part of the switching gas is fed into the deflector channel.

Turbulence of the switching gas discharged into the hot gas space can occur, particularly in the transition region from the nozzle channel to the deflector channel.

Due to the turbulence, the flow of switching gas into the hot gas space is relatively uneven. Particularly in the case of short time intervals, in which the filling and emptying of the hot gas space is to be carried out, such turbulence while still in the opening-out region of the nozzle channel can act in such a way that swirling takes place in individual zones of the hot gas space while other sections of the hot gas space are only subjected to a reduced turbulence.

BRIEF SUMMARY OF THE INVENTION

It is therefore the object of the invention to specify a switchgear assembly which enables an effective filling and emptying of the hot gas space with switching gas within short time intervals.

According to the invention, this is achieved with a switchgear assembly of the kind described in the introduction in that the deflector channel has a section which has an expanding cross section in the discharge direction.

By expanding cross-sectional areas of the deflector channel in the discharge direction, inflowing switching gas can be fed quickly from the region of the opening-out of the nozzle channel into remote regions of the hot gas space. When switching gas flows within a deflector channel, there is a fear of the flow speed reducing due to the friction which occurs in the interior of the deflector channel. If an expanding cross section is provided in the discharge direction, the switching gas can be guided and fed continuously or also in a step-like manner through regions of different flow resistances. In this way, larger quantities can also be fed through the deflector channel.

At the same time, it can be provided that the deflector channel undergoes an appropriate expansion of its cross section. However, this expansion does not necessarily also have to be carried out on the external sleeve side of the deflector channel. With an appropriate profiling of the channel, for example within a cylindrical base element, the form of the deflector element on the outer sleeve side can differ from a cross-sectional course of the deflector channel.

In a preferred embodiment, it can be provided, for example, that an approximately constant thickness of a wall of the deflector element is provided on the sleeve side so that a course of a wall which borders the deflector channel is also reflected in an outer sleeve surface of the deflector element. In order to expand the cross section of a section, the deflector element can be designed in the form of a funnel, for example. An inner wall in the expanding section can be cylindrical, curved, conical etc.

Furthermore, an advantageous embodiment can provide that the section is bounded by a sleeve surface in the shape of a truncated cone.

As well as a continuous expansion of the cross section of the deflector channel over its length, it can also be provided that the deflector channel is in each case sub-divided into different sections, wherein at least one of the sections has a course in the shape of a truncated cone, in particular in the shape of a hollow truncated cone. For example, it is therefore possible that a fitted element extends into the deflector channel, as a result of which a ring-shaped structure can be formed and with appropriate shaping a section in the shape of a hollow truncated cone can be produced. In this way, for example, it can be provided that, with a continuous expansion of the cross section of the deflector channel, it has a hollow truncated cone shape over its whole length or has such a shape only in certain sections. The wall thickness of the deflector element can vary or be designed to be approximately constant in the region of a section of the deflector channel which is in the shape of a hollow truncated cone.

A further advantageous embodiment can provide that the section is bounded by a cylindrical sleeve surface which expands in a step-like manner.

As well as a continuously expanding section, for example a section designed in the shape of a funnel which constitutes a transition between regions of the deflector channel which connect to this section, it can also be provided that step-like expansions in the deflector channel are provided. For example, it is therefore possible that the channel has a cylindrical internal sleeve surface, wherein sections with different diameters directly border one another and thus a projecting edge is formed in the course of the deflector channel, at which edge the deflector channel expands in a step-like manner in the discharge direction.

If a step-like expansion is provided, it is possible to produce a rapid expansion of cross-sectional areas in the course of the deflector channel in a short installation space. This enables switching gases to expand abruptly while still in the interior of the deflector channel. Pressure waves etc. can be produced in the switching gas flow even while the gas is flowing through the deflector channel, and this can affect the discharge flow behavior of the switching gas in the deflector channel and therefore also a discharge behavior of the switching gas from the nozzle channel.

A further advantageous embodiment can provide that the nozzle channel has a reduction in cross section in the region of an outlet opening.

For example, the nozzle channel opens out in the form of a ring channel or a channel with circular cross section in a surface of the hot gas space. In doing so, an outlet opening of the opening-out nozzle channel and an inlet opening of the deflector channel should be aligned approximately coaxially opposite one another to enable switching gas which is discharged from the nozzle channel to flow easily into the deflector channel. If an additional reduction in cross section is now provided in the region of the outlet opening of the nozzle channel, for example in the form of a nozzle, in particular a venturi nozzle, then the switching gas can be additionally accelerated and flow more selectively towards the inlet opening of the deflector channel. For example, a reduction in cross section can be provided in such a way that the nozzle channel has an approximately constant cross section in its last section in the direction of the outlet opening which is followed by a continuous restriction of the cross section at the outlet opening so that the outlet opening has the smallest cross section in the form of a nozzle constriction. A free flow of the switching gas between the outlet opening and the inlet opening is advantageous. A venturi nozzle, the take-off opening of which lies between outlet opening and inlet opening, is formed by the interaction of the nozzle constrictions of outlet opening and inlet opening which are aligned in opposition to one another. The take-off opening is designed in a ring shape, for example.

It can therefore be provided that appropriate projecting shoulders, convex moldings or similar structures are formed in the nozzle channel in the region of the outlet opening.

As a result of the nozzle effect of the outlet opening, discharged switching gas is concentrated onto a focal point.

Furthermore, it can advantageously be provided that the section forms a transition between a substantially cylindrical sleeve surface and a tapered section.

The section with the expanding cross section can, for example, open out into a cylindrical section or merge therewith. Furthermore, a tapered section can be connected to the section so that a two-stage cross-sectional expansion takes place in the course of the discharge direction of the deflector channel. For example, an inlet opening of the nozzle channel can be arranged in the tapering section so that an at least two-stage expansion of the cross section is provided in the discharge direction before the substantially hollow cylindrical section of the deflector channel. The cross-sectional area of the inlet opening of the deflector channel provided is therefore comparatively reduced, thus enabling a rapid low-turbulence inflow into the deflector channel when the switching gas emerging from the outlet opening of the nozzle channel is concentrated appropriately. In doing so, the aim should be for as much of the discharged switching gas as possible to enter the deflector channel from the nozzle channel. This reduces turbulence in the region between the outlet opening of the nozzle channel in the hot gas space and the inlet opening of the deflector channel. Due to the at least two-stage expansion of the deflector channel, it is possible to store insulating gas, which initially is barely swirled or mixed with the switching gas, in the hot space in the region of the outlet opening of the nozzle channel. This effects a separation of the insulating gas in the hot gas space and the switching gas which flows freely into the hot gas space. If necessary, this separation can be removed at a later time or also maintained during a process of filling and emptying the hot gas space with switching gas.

A space is provided between the wall of the hot gas space in which the outlet opening of the nozzle channel lies and the deflector element with the inlet opening. This enables switching gas to pass freely from the nozzle channel into the deflector channel. In the case of overpressure or congestion in the hot space, inflowing switching gas can escape via a gap between the outlet opening and the inlet opening. In such a case, switching gas and insulating gas are also mixed to a greater extent before the switching gas enters the deflector channel.

A further advantageous embodiment can provide that the tapered section constitutes a reduction in cross section at a free end facing the nozzle channel.

In order to effect a more selective guidance of the switching gas, the tapered section can constitute an additional restriction at its end facing the nozzle channel, thus forming an additional nozzle constriction. This nozzle constriction can be formed in the manner of a venturi nozzle, for example. The nozzle constriction enables an acceleration of the inflowing switching gas in the region of the inlet opening of the deflector channel and a subsequent expansion in the section with expanding cross section. In this way, switching gases can be diverted and guided in the section between the outlet opening of the insulated nozzle and the inlet opening of the deflector element, particularly in an interaction of a nozzle-like outlet opening of the nozzle channel and a nozzle-like inlet opening of the deflector channel. On the one hand, this provides a favorable diversion of switching gas escaping from the insulating material nozzle into the deflector channel. On the other, the free guidance of the switching gas stream within the hot gas space enables the switching gas to flow away into the free space between outlet opening of the nozzle channel and inlet opening of the deflector channel in the event of a fault. This reduces the risk of the insulating material nozzle or even the deflector element or other components bursting as a result of overpressure, for example.

A further advantageous embodiment can provide that radially aligned openings are arranged in a sleeve surface of the deflector element.

A radial arrangement of openings in the deflector element enables gases to escape and be dissipated from the deflector channel through penetrating openings in the course of the deflector element. After the switching gas has almost completely transferred from the nozzle channel into the deflector channel, it is therefore possible, for example, to allow at least some of the switching gas to discharge in a radial direction through the openings and thus achieve a rapid filling of zones of the hot space which are located at a distance from the outlet opening of the nozzle channel.

Advantageously, it can be provided that an angled impact wall is arranged opposite at least one opening.

An angled impact wall enables radially escaping extinguishing gases to be diverted in an aerodynamically efficient manner. The angled alignment of the impact walls enables the flow resistances in the interior of the hot gas space to be reduced. In this way, for example, it can be provided that some of the switching gas is deflected through 90 degrees through the radial openings in the deflector element and, after impacting against the impact wall, is diverted through a further 90 degrees, thus enabling a 180-degree reversal of at least some of the switching gas relative to the discharge direction to be produced. The impact wall can be designed, for example, so that it encompasses the deflector element in the form of an inner sleeve surface of a hollow truncated cone or some other suitable rotational solid, wherein a plurality of discharge nozzles is arranged in the form of a ring in the circumference of the impact wall.

Furthermore, it can advantageously be provided that the openings are arranged in a cylindrical sleeve surface.

Arranging the openings in a cylindrical section initially enables a rapid discharge to be promoted in the expanding cross-sectional region of the deflector channel. The inflowing switching gases therefore settle while still in the interior of the deflector channel in order to escape from the deflector channel in a radial direction via a multiplicity of openings in the region of a section with cylindrical sleeve surface which has an almost constant cross-sectional area in its course. As well as a deflection of the switching gas in radial directions, it can also be provided that at least some of the switching gas escapes following the discharge direction from an outlet opening of the deflector channel which is aligned substantially parallel to the inlet opening.

According to a further advantageous embodiment, it can be provided that the deflector element is held at its end which faces away from the insulating material nozzle.

Mounting the deflector element at an end enables the region of the deflector element which faces the outlet opening of the nozzle channel to extend freely into the hot gas space. As a result, this region can be formed into a suitable aerodynamically efficient shape irrespective of mechanical retaining devices. Particularly when switching gases discharge in radial directions, this switching gas must consequently be fed back on the outer sleeve side of the deflector element towards the insulating material nozzle once more, where, for example, it can also flow into the nozzle channel via the free space which is located between the outlet opening of the insulating material nozzle and the inlet opening of the deflector element which are disposed at a distance from one another. It is therefore possible to feed the switching gas out of the nozzle channel of the insulating material nozzle into the deflector channel virtually without turbulence and there deflect the switching gas in a radial direction in order to allow it to flow in the opposite direction along the outer sleeve surface of the deflector element back towards the nozzle channel. A return flow can also advantageously take place along an outer sleeve surface of the section with expanding cross section, wherein the ensuing cross section in this region for the feedback expands in the opposite direction to the discharge direction. Advantageously, this can be achieved with a rotationally symmetrical shape of the deflector element, wherein a wall thickness of the deflector element is chosen such that the shape of the deflector channel is reflected in an outer sleeve surface of the deflector element.

Depending on the number of openings and the position of the openings in the deflector element, before the switching gas flows into the deflector channel, cold insulating gas located in the hot gas space can be kept away from the hot switching gas virtually without mixing. The dielectric properties of this cold insulating gas can therefore only be slightly affected by hot switching gas. With the switch arrangement, a favorable extinguishing performance can be achieved in that cold insulating gas is pressed out of the hot gas space by the hot switching gas which has been fed into and subsequently deflected inside the deflector channel.

The deflector element can be connected in one piece to a contact piece, for example. However, it can also be provided that the deflector element is connected by means of a screw fixing, welding or other suitable jointing process to further assemblies of the switchgear assembly. At the same time, the deflector element can have electrically conducting or electrically insulating properties, for example.

A further advantageous embodiment can provide that the hot gas space is arranged between a first and a second contact piece which are aligned coaxially in each case.

Switchgear assemblies, which are designed to switch higher powers, are usually equipped with a set of arc contact pieces and rated current contact pieces. In doing so, the rated current contact pieces and the arc contact pieces are designed differently from one another. For example, it is therefore provided that the arc contact pieces preferably serve to guide an arc and therefore have appropriately erosion-resistant surface regions. The rated current contact pieces, which are protected against arcs by the arc contact pieces, can be optimized with regard to the electrical current carrying capability, as an occurrence of arcs at these rated current contact pieces is rather unlikely.

At the same time, it is usually provided that, during a switch-on operation, a galvanic connection of the arc contact pieces takes place first followed by a connection of the rated current contact pieces and, during a switch-off operation, a separation of the rated current contact pieces occurs first followed by a separation of the arc contact pieces. Because of the early and late connection/separation respectively of the arc contact pieces, preliminary flashovers and switch-off arcs are preferably guided between the arc contact pieces. At the same time, it can be provided that the respectively associated rated current and arc contact pieces are aligned coaxially with one another. Advantageously, the rated current contact pieces, which in each case have the same potential irrespective of the switching state of the switchgear assembly, encompass the arc contact pieces. At the same time, the arc and rated current contact pieces are preferably designed to be rotationally symmetrical, so that the arc contact piece is encompassed by an associated rated current contact piece, wherein a hot gas space can be positioned between an inner sleeve surface of the rated contact piece and an outer sleeve surface of the arc contact piece. In doing so, it is advantageous when adjacent sleeve surfaces of the hot gas space are accordingly formed by arc and rated current contact piece respectively. If necessary, the face surfaces must be appropriately temporarily sealed by further assemblies. At the same time, when the hot gas space is formed between two coaxially aligned contact pieces, it is advantageous when an outlet opening of an insulating material nozzle opens out into the hot gas space on the face side, preferably coaxially, with respect to one of the contact pieces.

An advantageous embodiment can provide that the deflector element is connected in one piece to one of the contact pieces.

A single-piece design enables a contact piece and the deflector element, for example, to be formed in a single casting process. It can therefore be provided, for example, that one of the rated current contact pieces is formed at least in sections from an aluminum casting. With an appropriate design of the mold, the deflector element can then be designed in one piece with the contact piece. It can be provided that the deflector element is additionally covered, at least in sections, with electrically insulating material. However, it can also be provided that the surfaces of the deflector element are formed completely by electrically insulating materials.

A further advantageous embodiment can provide that the deflector element is attached to a connecting element which couples the two contact pieces in an angularly rigid manner.

For example, a first and second contact piece can be designed as arc and as rated current contact piece, wherein these two contact pieces are associated with one another and lie on "one side" of a contact gap of the switchgear assembly. As a result, the two contact pieces always have the same electrical potential irrespective of the switch position of the switchgear assembly. A connecting element, which couples the two contact pieces together, is provided in order to position the two contact pieces with respect to one another and to support them against one another. At the same time, a rigid coupling of the two contact pieces can be provided. However, it can also be provided that a gear is arranged in the course of the coupling, thus enabling a relative movement between the two contact pieces.

The deflector element can be connected to the connecting element in such a way that they are formed in one piece or that said connecting element is attached by means of a releasable connection.

A further advantageous embodiment can provide that a wall which borders the nozzle channel extends into the deflector channel.

Advantageously, the nozzle channel can have a rotationally symmetrical structure. At the same time, it can particularly be provided that the nozzle channel has a hollow cylindrical structure in the region of the outlet opening, wherein an element, for example an arc contact piece and/or an auxiliary nozzle, extends into the insulating material nozzle, thus resulting in a hollow cylindrical shape of the nozzle channel. This extending element forms a wall which borders the nozzle channel and can advantageously also extend into the deflector channel and pass at least partially therethrough. Advantageously, this element should pass through the deflector channel over its whole length. This enables the cross section of the deflector channel to be adjusted and, when switching gas overflows from the nozzle channel into the deflector channel, there is a wall, against which the hot switching gas can slide along, and the hot switching gas can pass smoothly from the one channel into the other channel due, for example, to the additional nozzle-like restriction of the outlet opening of the nozzle channel and the nozzle-like constriction of the inlet opening of the deflector channel. An appropriate shaping of the wall can additionally support the progression of a change in cross section of the deflector channel.

A further advantageous embodiment can provide that the deflector element is electrically conducting.

An electrically conducting design of the deflector element enables an electrical potential to be transferred from a contact piece to the deflector element and therefore, for example, to form field-free spaces between walls which are at the same potential. This can reduce the risk of partial discharges occurring. As well as an electrically conducting design of the deflector element, this can at least in sections be covered with electrically insulating materials. This can promote an additional emission of hard gas in the interior of the hot gas space when hot switching gas flows in. However, it can also be provided that the deflector element is formed completely from electrically insulating materials if necessary.

A further advantageous embodiment can provide that the nozzle channel opens out into the hot gas space in the form of a ring.

A ring-shaped opening-out of the nozzle channel into the hot gas space enables the discharge of switching gas to be supported, resulting in a flow which is as laminar as possible after emerging from the outlet opening of the nozzle channel. For example, this laminar flow can extend along a wall which splits up at least the insulating nozzle channel into a ring-shaped channel. A low-turbulence transfer of the switching gas into the deflector channel can be assisted if this element, which allows the outlet opening to appear as a ring-shaped opening, also extends into the deflector channel.

A further advantageous embodiment can provide that the deflector element is supported on the outer sleeve side.

Supporting the deflector element on the outer sleeve side enables an almost freely configurable design of the cross section in the course of the deflector channel. The deflector channel is free from mounting elements or fitted parts and can therefore be optimized with regard to the diversion and guiding of switching gas. A support on the outer sleeve side also makes it easy to install the deflector in the interior of the hot gas space. In this way, for example, the deflector element can be connected in one piece to further assemblies. Furthermore, as a result of supporting on the outer sleeve side, a discharge of switching gas can be provided from an outlet opening arranged on the opposite end to the inlet opening of the insulating nozzle channel. Further assemblies, such as merging channels, overflow openings, valves and the like, can be arranged in this area.

The invention is shown schematically below in a drawing with reference to an exemplary embodiment and subsequently described in more detail.

In the drawing:

DESCRIPTION OF THE INVENTION

Figure 1:
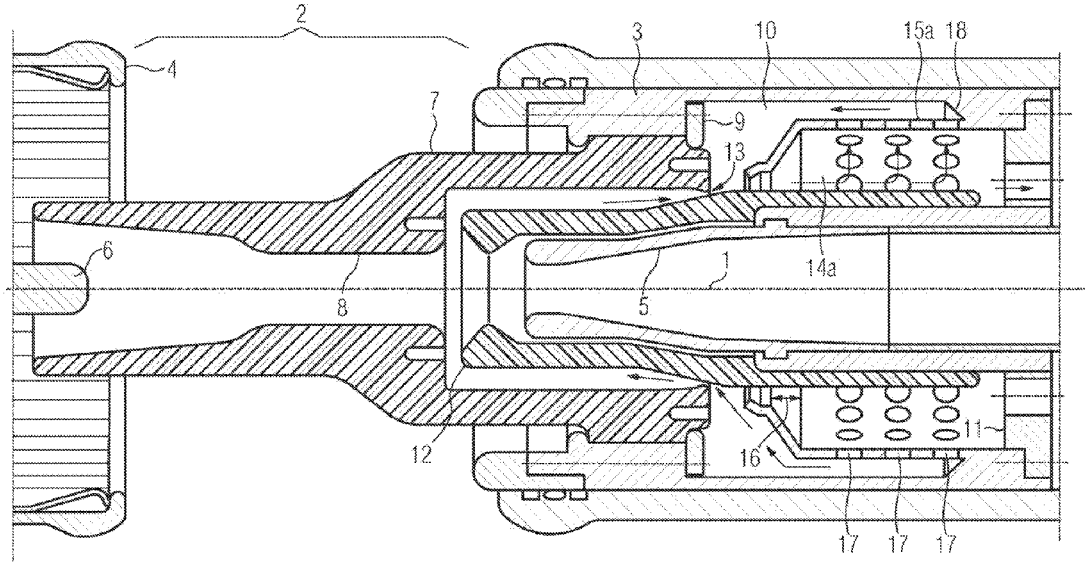
FIG. 1 shows a section through a switchgear assembly with a first variant of a deflector element.
Figure 2:
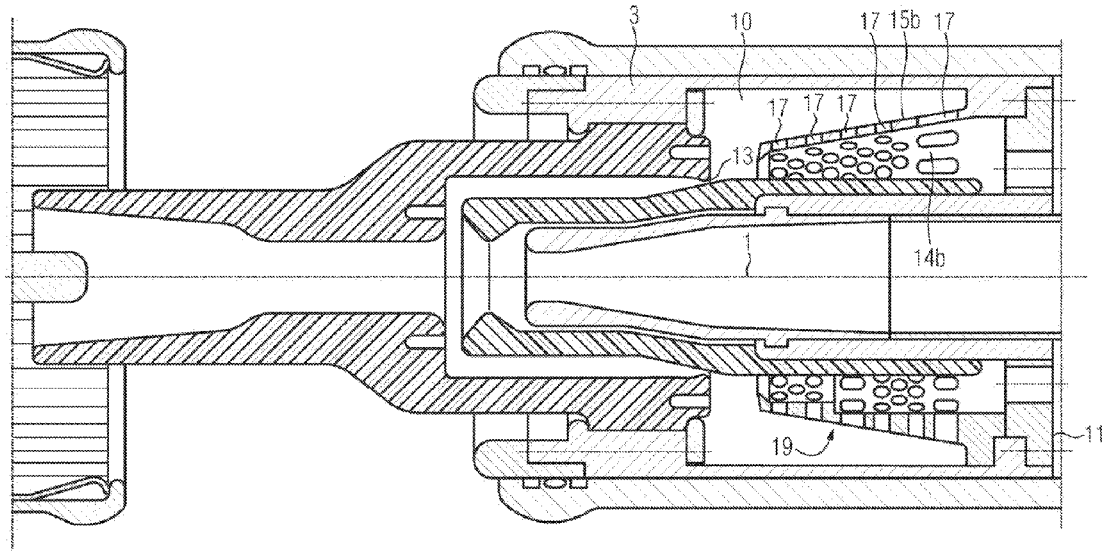
FIG. 2 shows a switchgear assembly with a second variant of a deflector element in two embodiments.
Figure 3:
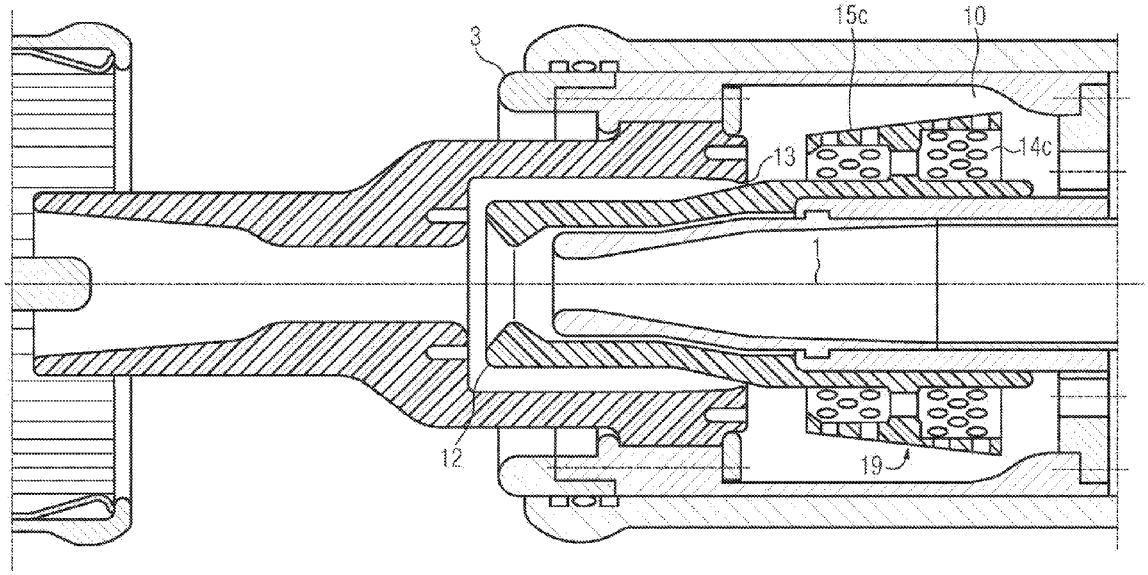
FIG. 3 shows a switchgear assembly with a third variant of a deflector element in two embodiments.

FIGS. 1, 2 and 3 in each case show identically operating switchgear assemblies which differ from one another essentially in the different designs of deflector elements arranged in a hot gas space. Therefore, the basic design of a switchgear assembly will first be described by way of example with reference to FIG. 1. The comments relating to the switchgear assembly as shown in FIG. 1 also apply in a similar manner to the switchgear assemblies shown in FIGS. 2 and 3. Accordingly, assemblies which have the same effect are designated in the figures with the same references.

A switchgear assembly is shown in section in FIG. 1. The switchgear assembly has a substantially rotationally symmetrical structure which extends around a longitudinal axis 1. The switchgear assembly has a contact gap 2. The contact gap 2 extends between a first arc contact piece 5 and a second arc contact piece 6. A first rated contact current piece 3 and a second rated contact current piece 4 are associated with the arc contact pieces 5, 6 respectively. The rated current contact pieces 3, 4 and the arc contact pieces 5, 6 are in each case formed in a rotationally symmetrical manner with respect to the longitudinal axis 1 and arranged coaxially with respect to the longitudinal axis 1. At the same time, the first arc contact piece 5 has a tubular structure which has a bell-shaped bush at its end facing the second arc contact piece 6. Accordingly, the second arc contact piece 6 is designed in the form of a bolt in order that it can be moved into the bush of the first arc contact piece 5 while making galvanic contact. The second rated current contact piece 4 has a multiplicity of contact fingers which are elastically deformable and which can be moved towards a sleeve surface of the first rated current contact piece 3 in order to make contact with the first rated current contact piece 3.

The first rated current contact piece 3 and the first arc contact piece 5 are associated with one another. The second rated current contact piece 4 and the second arc contact piece 6 are likewise associated with one another. The associated contact pieces always have the same electrical potential irrespective of a switching state of the switchgear assembly.

The rated current contact pieces 3, 4 and the arc contact pieces 5, 6 can be moved relative to one another along the longitudinal axis 1 so that rated current contact pieces 3, 4 and arc contact pieces 5, 6 can make contact with one another. At the same time, it is provided that, during a switch-on operation, the arc contact pieces 5, 6 come into contact with one another at a point in time before the rated current contact pieces 3, 4. During a switch-off operation, the rated current contact pieces 3, 4 separate first followed in time by the arc contact pieces 5, 6.

Due to the time offset between the connection and separation of the arc contact pieces 5, 6 and rated current contact pieces 3, 4, a switch-on or switch-off arc is guided between the arc contact piece 5, 6. An insulating material nozzle 7 is provided in order to beneficially divert and guide a burning arc. The insulating material nozzle 7 has a nozzle channel 8. At the same time, the nozzle channel 8 is designed to be rotationally symmetrical and has a constriction which can be plugged temporarily by the second arc contact piece 6. The nozzle channel 8 of the insulating material nozzle 7 at least partially encompasses the contact gap 2 and is aligned coaxially with respect to the longitudinal axis 1. The insulating material nozzle 7 is fitted on the outer sleeve side with a circumferential collar which is mounted in an angularly rigid manner in an identical but opposite recess on the first rated current contact piece 3. A screw fixing 9 is provided to secure the insulating material nozzle 7 on the first rated current contact piece 3.

The first arc contact piece 5 extends into the nozzle channel 8 of the insulating material nozzle 7, as a result of which the section of the nozzle channel 8 facing a hot gas space 10 is formed in the shape of a ring channel. The hot gas space 10 is designed substantially in the form of a hollow cylindrical storage space, wherein the outer sleeve surface of the hot gas space 10 is bounded by the first rated current contact piece 3, and the inner sleeve surface by the first arc contact piece 5 or by an insulating material which encompasses the first arc contact piece 5. At its end which faces the second arc contact piece 6, the hot gas space 10 is bounded on its face side by a surface of the insulating material nozzle 7. Furthermore, this face side of the hot gas space 10 is bounded by the screw fixing 9 and parts of the rated current contact piece 3. A connecting element 11 is arranged on the opposite face end of the hot gas space 10. The connecting element 11 couples the first rated current contact piece 3 to the first arc contact piece 5 so that these are actively connected to one another and this connecting element 11 provides an electrically conducting connection between these two contact pieces 3, 5. Recesses, which run in the direction of the longitudinal axis 1, are arranged in the connecting element 11.

The region of the first arc contact piece 5, which extends into the nozzle channel 8, is encompassed by an auxiliary nozzle 12 made of insulating material. One wall of the auxiliary nozzle 12 borders the nozzle channel 8, in particular in the region of its substantially hollow cylindrical form. At the same time, the auxiliary nozzle 12 extends beyond the first arc contact piece 5 towards the second arc contact piece 6. Furthermore, the auxiliary nozzle 12 also at least partially encloses the first arc contact piece 5 in the interior of the hot gas space 10. A ring-shaped outlet opening 13 is located in the surface of the insulating material nozzle 7 where the nozzle channel 8 opens into the hot gas space 10. At the same time, a restriction of the ring-shaped section of the nozzle channel 8 is provided in the immediate vicinity of the outlet opening 13 so that a nozzle constriction is formed directly in the region of the outlet opening 13. In the present case, the insulating material nozzle 7 is provided with a corresponding radially-inward-pointing molding to form the nozzle constriction. The nozzle effect is assisted by the radially expanding auxiliary nozzle 12 in the region of the outlet opening 13. In addition, further designs of the region of the outlet opening 13 of the nozzle channel 8 can also be provided to form a nozzle. For example, projecting shoulders, ramps, restrictions or other suitable moldings can be arranged in the channel to achieve a nozzle effect. Switching gas discharging from the outlet opening 13 of the nozzle channel 8 is guided into a deflector channel 14*a* of a deflector element 15*a* in the discharge direction. The discharge direction runs parallel to the longitudinal axis 1.

FIG. 1 shows a first variant of a deflector element 15*a* with a deflector channel 14*a*. The principle of operation of the deflector elements 15*b*, 15*c* and deflector channels 14*b*, 14*c* shown in FIGS. 2 and 3 is the same in each case. Only the structural design differs from one to the other.

The operation of a deflector element is described below by way of example with reference to FIG. 1.

The deflector channel 14*a* has a substantially rotationally symmetrical hollow structure and is arranged coaxially with respect to the longitudinal axis 1. At the same time, according to FIG. 1, the deflector element 15*a* has a single-piece connection to the first rated current contact piece 3. The deflector element 15*a* according to FIG. 1 is connected to and is held by the first rated current contact piece 3 at its end facing away from the outlet opening 13. A single-piece design of deflector element 15*a* and rated current contact piece 3 is provided in the present case. In addition, the deflector element 15*a* can also be fixed in an alternative manner. The deflector channel 14*a* formed in the interior of the deflector element 15*a* has an inlet opening. The inlet opening is arranged at the end of the deflector element 15*a* which faces the outlet opening 13. At the same time, the deflector element 15*a* is sized in such a way that a slot-shaped free space is provided between the outlet opening 13*a* and the inlet opening of the deflector channel 14*a*. This slot-shaped free space allows, for example, excess quantities of switching gas to discharge, and switching gas or insulating gas to flow back. At its end facing the outlet opening 13, the inlet opening is likewise provided with a cross-section restriction so that a nozzle constriction of a nozzle is likewise formed in the region of the inlet opening of the deflector channel 14*a*. At the same time, the directionality of the nozzles at the outlet opening 13 of the nozzle channel 8 and of the nozzle of the inlet opening of the deflector channel 14*a* are aligned in opposite directions to one another, i.e. a continuous narrowing is provided in the discharge direction of the switching gas out of the outlet opening 13 to form a nozzle at the outlet opening 13. Conversely, the nozzle constriction at the inlet opening is correspondingly formed in such a way that the cross section of the deflector channel 14*a* expands starting from the inlet opening of the deflector channel 14*a*.

As a result of the nozzle effect, switching gas discharging from the outlet opening 13*a* is discharged against an outer sleeve surface of the auxiliary nozzle 12 and flows along the outer sleeve surface of the auxiliary nozzle 12 into the deflector channel 14*a*. Inside the deflector channel 14*a* is a section 16 which expands in the discharge direction of the switching gas. At the same time, this section is provided with a sleeve surface which is substantially in the form of a truncated cone. Preferably, this section 16 of the deflector channel 14*a* should be designed in the form of a hollow truncated cone. Connected to the section 16 is a hollow cylindrical section which provides an approximately constant cross-sectional area of the deflector channel 14*a*. The section 16 and the nozzle-shaped taper which lies upstream thereof in the discharge direction form a funnel-shaped transition from the inlet opening to the hollow cylindrical section.

An outlet opening of the deflector channel 14*a* is at least partially covered by the connecting element 11 so that hot switching gas which flows via the inlet opening into the deflector channel 14*a* can also be deflected radially outwards by 90 degrees by means of radially aligned openings 17. Some of the switching gas which flows into the deflector channel 14*a* can also flow further in the discharge direction through openings in the connecting element 11. In the present case, the auxiliary nozzle 12 is sized so that it partially borders the deflector channel 14*a*. It can also be provided that the auxiliary nozzle is sized in such a way that the deflector channel 14*a* is also bordered over its whole length by a sleeve surface of the auxiliary nozzle 12.

An angled impact wall 18 is associated with at least some of the openings 17. The angled arrangement of the impact wall 18 assists the deflection of the portion of the radially-outwards-guided switching gas by a further 90 degrees so that switching gas which is diverted in the discharge direction into the interior of the deflector channel 14*a* is guided radially outwards through the opening 17 and is fed back in the opposite direction along outer sleeve surfaces of the deflector element 15*a*.

In the diagram shown in FIG. 1, the inflow of switching gases is shown by several arrows above the longitudinal axis 1. A return flow of switching gases along outer sleeve surfaces of the deflector element 15*a* in the opposite direction to the discharge direction is shown below the longitudinal axis 1, wherein the switching gas re-enters the outlet opening 13 at a given point in time and flows back towards the second arc contact piece 6.

As can be seen from FIG. 1, the deflector element 15*a* here has a substantially constant wall thickness so that the shape of the deflector channel 14*a* is also reflected in the outer sleeve surfaces of the deflector element 15*a*.

The principle of operation and function of a flow of switching gases is described schematically below.

In a switching operation, in particular a switch-off operation, a switching arc burns between the two arc contact pieces 5, 6. The arc produces switching gas, especially while the nozzle constriction is plugged by the second arc contact piece 6. This occurs by heating and expanding insulating gas, such as sulfur hexafluoride, nitrogen or other suitable gases or gas mixtures for example, which are present in the switchgear assembly. At least some of the expanded switching gas is fed via the nozzle channel 8 towards the hot gas space 10. At the same time, a diversion takes place in the region of the outlet opening 13 in such a way that the hot switching gas is largely, in particular almost completely, diverted into the inlet opening of the deflector channel 14*a*. Cold insulating gas is already present in the hot gas space 10. This cold insulating gas initially driven by the hot switching gas is driven out of the deflector channel 14*a* through the openings 17. In the further course of events, switching gas collects in the hot gas space 10 to an ever increasing extent so that the pressure inside the hot gas space 10 increases. When the nozzle constriction of the nozzle channel 8 is unblocked, the gas stored at increased pressure in the hot gas space 10 can flow out. As a discharge of cold insulating gas through the outlet opening 13 has been prevented up to now due to the inflowing switching gas, when the nozzle constriction of the insulating material nozzle 8 is unblocked, the cold insulating gas buffered in the region of the free space between outlet opening 13 and inlet opening which has been compressed by the hot switching gas is initially expelled. This is followed by a discharge of the hot switching gas.

A mixing of cold insulating gas and hot switching gas in the hot gas space 10 can be limited by arranging a deflector element 15*a* within the hot gas space 10. As a result, it is possible for the contact gap 2 to be initially flooded with cold insulating gas in the region of the insulating material nozzle 7. Cold insulating gas has an improved cooling and insulating effect compared with hot switching gas. It is therefore possible to achieve high pressures within the switching gas space in just a short time, and at the same time to allow only a limited mixing of inflowing hot switching gas and cold insulating gas located in the hot gas space 10.

FIG. 2 shows the switchgear assembly disclosed in FIG. 1, wherein a second variant of a deflector element 15*b* is shown in the hot gas space 10. The deflector element 15*b* is shown above the longitudinal axis 1 in a first embodiment and below the longitudinal axis 1 in a second embodiment. The deflector element 15*b* according to FIG. 2 has an outer sleeve surface which is substantially in the form of a truncated cone. Here, the first embodiment shown above the longitudinal axis 1 has a constant wall thickness over a large part of the length of the deflector element 15*b* so that the deflector channel 14*b* according to FIG. 2, which extends in the interior of the deflector element 15*b*, expands almost continuously and has a hollow-cone-shaped form. At its end which faces the outlet opening 13, the deflector element 15*b* is provided with a projecting shoulder, resulting in a tapered section with nozzle-like constrictions directly in the region of the inlet opening. In the first embodiment of the deflector element 15*b* according to FIG. 2, the deflector element 15*b* is connected in one piece to the first rated current contact piece 3. Variations of the form and arrangement of the openings 17 are also shown.

Unlike the form of the first embodiment above the longitudinal axis 1, the second embodiment below the longitudinal axis 1 is provided with a step-like expansion 19 on the inner sleeve side, so that the deflector channel 14*b* according to FIG. 2 below the variant shown the longitudinal axis is formed from two abutting hollow cylindrical sections which form a step-like expansion 19. Furthermore, in the second embodiment of the deflector element 15*b*, a screw fixing of the deflector element 15*b* is provided, wherein this screw fixing takes place together with the connecting element 11 on a projecting shoulder of the first rated current contact piece 3. The action of the deflector element 15*b* with its deflector channel 14*b* in both embodiments above and below the longitudinal axis 1 is as described for FIG. 1.

While the designs of the deflector element 15*a*, 15*b* according to FIGS. 1 and 2 are essentially provided in an electrically conducting material, in the third embodiment according to FIG. 3, a design of the deflector element 15*c* here is provided as an insulated part. At the same time, it can be provided that parts of the deflector element 15*c* according to FIG. 3 are equipped with metallic reinforcements. Likewise, it can also be provided that the deflector elements 15*a*, 15*b* according to FIGS. 1 and 2 respectively are at least partially provided with covers made from insulating material.

The third variant of a deflector element 15*c* according to FIG. 3 is designed sitting on the auxiliary nozzle 12. In the present case, a single-piece connection is provided between auxiliary nozzle 12 and deflector element 15*c*. An outer sleeve surface of the insulating material nozzle 12 passes completely through the deflector element 15*c* and therefore also the deflector channel 14*c*. It can also be provided that the insulating material nozzle 12 only extends partially into the deflector element 15*c*. The deflector channel 14*c* according to FIG. 3 encompassed by the deflector element 15*c* has a ring structure. At the same time, a continuous expansion of the deflector channel 14*c* is provided in the first embodiment above the longitudinal axis 1. Again, a projecting nose, which constitutes a taper in the form of a nozzle constriction directly in the region of the inlet opening, is provided in the region of the switching gas inlet opening of the deflector element 15*c*. The deflector element 15*c* is supported on the auxiliary nozzle 12 by means of struts which are located in the interior of the deflector channel 14*c*.

In the second embodiment of the deflector element 15*c* shown below the longitudinal axis 1, it is provided that a sleeve surface in the shape of a truncated cone is provided on the outer sleeve side, while the inner sleeve side of the deflector element 15*c*, which borders the deflector channel 14*c*, is bordered by two abutting substantially hollow cylindrical sections, wherein a step-like expansion 19 occurs from the one section with the smaller cross section to the other section with the larger cross section. Struts for supporting the deflector element 15*c* are preferably to be arranged in the region of the step between the two hollow cylindrical sections of the deflector channel 14*c*.

Unlike the designs shown in FIGS. 1 and 2, a space is provided from the face wall of the hot gas space 10 at the end of the deflector channel 14*c* which faces away from the outlet opening 13.

Although the invention has been illustrated and described by means of the preferred embodiments, the invention is not restricted to the disclosed examples and other variations can be derived therefrom by the person skilled in the art. In particular, variants of the shape of the openings as well as shapes of the deflector channels and of the deflector elements are conceivable. Preferably, however, with the alignment of the nozzle positions and of the outlet opening 13 and of the inlet opening of the deflector channels 14*a*, 14*b*, 14*c*, it should be adhered to that the nozzle effects are aligned in opposite directions to one another so that switching gas discharging from the outlet opening is guided as radially inwards as possible to the longitudinal axis 1 against a sleeve surface of the auxiliary nozzle 12 or a sleeve surface of the first arc contact piece 5 and is accordingly transferred into the opposingly directed nozzle constriction of the inlet opening of the deflector channel.

The invention claimed is:

1. A switchgear assembly, comprising:

an insulating material nozzle at least partially enclosing a contact gap of the switchgear assembly, said nozzle having a nozzle channel opening out into a hot gas space;

a deflector element disposed inside said hot gas space and formed with a deflector channel, wherein extinguishing gas discharging from said nozzle channel in a discharge direction into said hot gas space is diverted into said deflector channel, said deflector channel having a segment formed with a cross section expanding in the discharge direction.

2. The switchgear assembly according to claim 1, wherein said segment is bounded by a sleeve surface having a shape of a truncated cone.

3. The switchgear assembly according to claim 1, wherein said segment is bounded by a cylindrical sleeve surface that expands in steps.

4. The switchgear assembly according to claim 1, wherein said nozzle channel has a cross section and an outlet opening, and wherein said cross section is reduced in a region of said outlet opening.

5. The switchgear assembly according to claim 1, wherein said segment forms a transition between a substantially cylindrical sleeve surface and a tapered section.

6. The switchgear assembly according to claim 5, wherein said tapered section constitutes a reduction in cross section at a free end of said segment facing towards said nozzle channel.

7. The switchgear assembly according to claim 1, wherein said deflector element is formed with a sleeve surface, and said sleeve surface has radially aligned openings formed therein.

8. The switchgear assembly according to claim 7, which comprises an angled impact wall disposed opposite from at least one of said radially aligned openings.

9. The switchgear assembly according to claim 7, wherein said sleeve surface is a substantially cylindrical sleeve surface and said radially aligned openings are formed in said cylindrical sleeve surface.

10. The switchgear assembly according to claim 1, wherein said deflector element is held at an end thereof facing away from said insulating material nozzle.

11. The switchgear assembly according to claim 1, wherein said hot gas space is formed between a first contact piece and a second contact piece and said first and second contact pieces are aligned coaxially in each case.

12. The switchgear assembly according to claim 11, wherein said deflector element is connected in one piece to one of said contact pieces.

13. The switchgear assembly according to claim 11, wherein said deflector element is attached to a connecting element which couples said first and second contact pieces in an angularly rigid manner.

14. The switchgear assembly according to claim 1, wherein a wall bordering said nozzle channel extends into said deflector channel.

15. The switchgear assembly according to claim 1, wherein said deflector element is an electrically conducting element.

16. The switchgear assembly according to claim 1, wherein said nozzle channel opens out into said hot gas space in the form of a ring.

17. The switchgear assembly according to claim 1, wherein said deflector element is supported on an outer sleeve side.

* * * * *